US006966405B2

(12) United States Patent
St-Pierre et al.

(10) Patent No.: US 6,966,405 B2
(45) Date of Patent: Nov. 22, 2005

(54) SWIMMING POOL STAIRS

(75) Inventors: Jacques St-Pierre, Bromptonville (CA); Jérôme Foy, Orford (CA)

(73) Assignee: Prado Technologies, Bromptonville (CA)

( * ) Notice: Subject to any disclaimer, the term of this patent is extended or adjusted under 35 U.S.C. 154(b) by 0 days.

(21) Appl. No.: 10/314,313

(22) Filed: Dec. 9, 2002

(65) Prior Publication Data

US 2003/0106743 A1 Jun. 12, 2003

Related U.S. Application Data

(60) Provisional application No. 60/351,003, filed on Jan. 25, 2002.

(51) Int. Cl.[7] ..... E04G 3/00; E06C 9/00

(52) U.S. Cl. ..... 182/93

(58) Field of Search ..... 182/93, 194, 94; 52/182, 184, 169.7; D25/62, 63

(56) References Cited

U.S. PATENT DOCUMENTS

| | | | | |
|---|---|---|---|---|
| 3,944,280 A | | 3/1976 | Keeler | |
| 4,537,282 A | | 8/1985 | Lobdell | |
| 4,599,835 A | | 7/1986 | Rinke | |
| 5,644,873 A | | 7/1997 | Bourgault | |
| 6,000,494 A | * | 12/1999 | Wilson | 182/93 |

FOREIGN PATENT DOCUMENTS

| | | |
|---|---|---|
| EP | 0 741 218 A1 | 11/1996 |
| EP | 0 816 595 A1 | 1/1998 |
| FR | 2 773 189 | 7/1999 |

OTHER PUBLICATIONS

International Search Report; PCT/CA2003/000076; Jun. 4, 2003.

* cited by examiner

*Primary Examiner*—Hugh B. Thompson, II

(57) ABSTRACT

A stair portion for a stair assembly for a swimming pool, comprising a bottomless hollow body having lateral surfaces and a top surface defining steps. The bottomless hollow body is adapted to be received in a pool with bottom edges of the lateral surface lying against a bottom of the pool such that a user person can move in or out of the pool using the steps. The bottomless hollow body is adapted to be connected to a pool connector portion for being secured adjacent to a sidewall of the pool. The bottomless hollow body is adapted to be nested with another bottomless hollow body, so as to facilitate transportation, warehouse storage or maneuverability in a body of water.

25 Claims, 6 Drawing Sheets

SWIMMING POOL STAIRS

CROSS-REFERENCE TO RELATED APPLICATIONS

This application claims the benefit of domestic priority of U.S. provisional patent application No. 60/351,003 filed on Jan. 25, 2002. The contents of the above noted document are incorporated herein by reference.

TECHNICAL FIELD

The present invention generally relates to swimming pools and, more particularly, to stairs and other accessories therefor.

BACKGROUND ART

Various stair and step systems have been created for swimming pools. For instance, U.S. Pat. No. 5,644,873, issued to Bourgault on Jul. 8, 1997, and U.S. Pat. No. 6,000,494, issued to Wilson on Dec. 14, 1999, both disclose stair systems preferably used with aboveground pools. In designing stair or step systems for swimming pools, such systems must adapt to the various installations, such as the type of pool (i.e., aboveground pool/in-ground flat-bottom pool/dish-bottom pool, seat width of the pool), the direct environment of the pool (i.e., wooden deck), etc . . . The pools also have varying depths, and the floor level adjacent to an aboveground pool may vary. Accordingly, all these factors must be taken into account in designing a versatile stair system for swimming pools.

SUMMARY OF INVENTION

It is a feature of the present invention to provide swimming pools stairs generally adapted for all types and configurations of pools.

Therefore, in accordance with a broad aspect of the present invention, there is provided a stair portion for a stair assembly for a swimming pool, comprising a bottomless hollow body having lateral surfaces and a top surface defining steps, the bottomless hollow body adapted to be received in a pool with at least one bottom edge of the lateral surface lying against a bottom of the pool such that a user person can move in or out of the pool using the steps, the bottomless hollow body adapted to be connected to a pool connector portion for being secured adjacent to a sidewall of the pool, the bottomless hollow body adapted to be nested with another one of the bottomless hollow body, so as to facilitate at least one of transportation, warehouse storage, maneuverability and installation in a body of water.

In accordance with a further broad aspect of the present invention, there is provided a stair assembly for a swimming pool comprising a stair portion defining steps and adapted for being received in a pool, said stair portion having a ballast; and a pool connector portion connected to said stair portion for securing said stair portion adjacent to a sidewall of the pool, said pool connector portion being adapted to be secured to a ledge of the pool and having a translationary coupling with said stair portion for vertical adjustment therebetween as a function of one of a height of a sidewall and a depth of the pool.

In accordance with a still further broad aspect of the present invention, there is provided a stair portion for a stair assembly for a swimming pool, comprising a hollow body having lateral surfaces and a top surface defining steps, one of said steps having a ballast receiving portion, the hollow body adapted to be received against a bottom of a pool such that a person can move in or out of the pool using the steps, the hollow body adapted to be connected to a pool connector portion for being secured adjacent to a sidewall of the pool; and a ballast adapted to be received in the ballast receiving portion.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
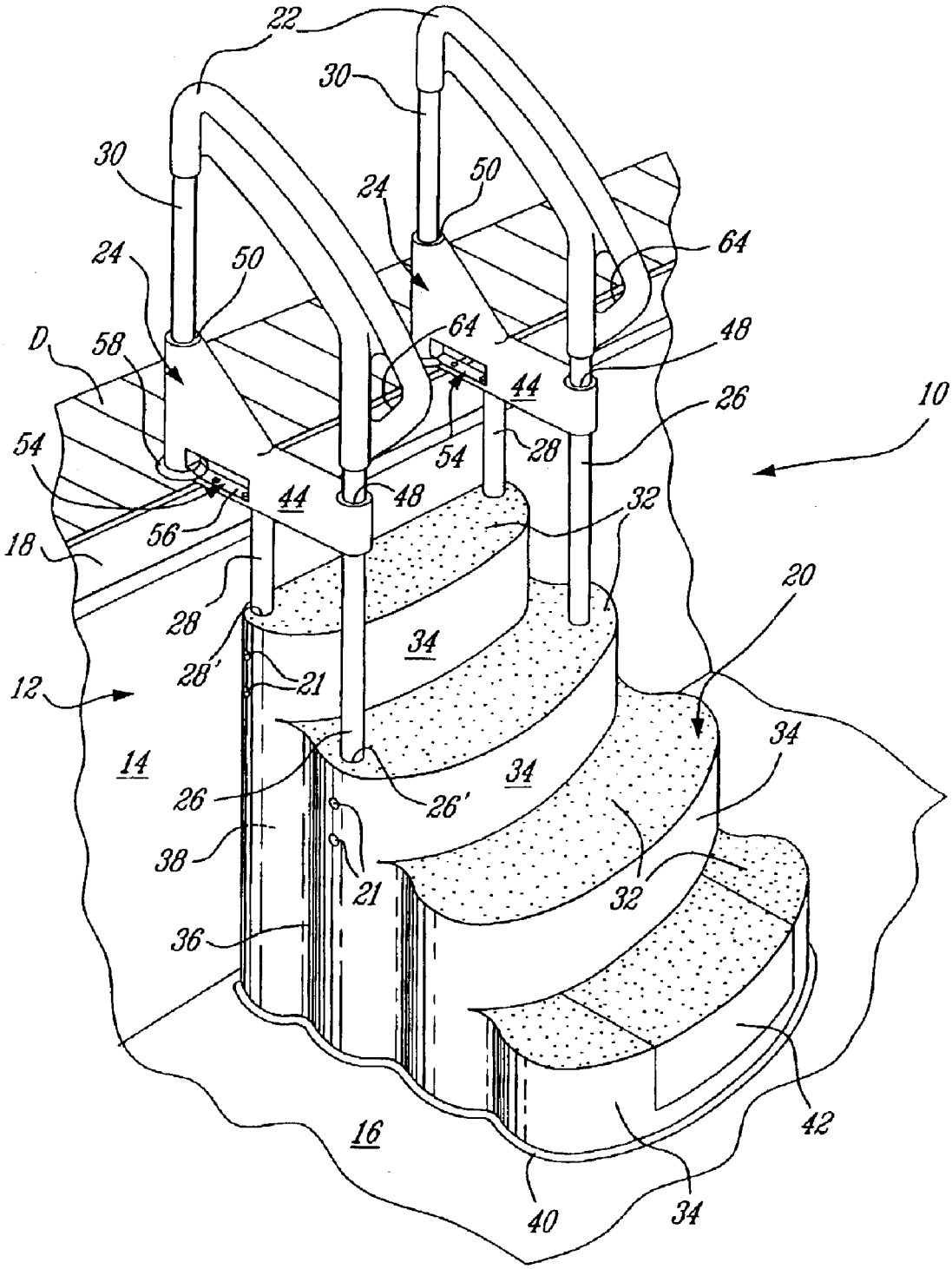
FIG. 1 is a perspective view of swimming pool stairs in accordance with the present invention.

Referring to the drawings, and more particularly to FIG. 1, swimming pool stairs in accordance with the present invention are generally shown at 10. The swimming pool stairs 10, hereinafter stairs 10, are shown installed in an aboveground pool 12 having a sidewall 14 and a bottom surface 16. Typical sidewalls of aboveground pools have heights of 48", 52" or 54". A ledge 18 (i.e., seat) covers an upper edge of the sidewall 14, as typically found on aboveground pools. Although the stairs 10 are illustrated in an aboveground pool, they are also adapted for being used with in-ground pools. For the clarity of the illustrations, water has been removed from the pool 12.

Figure 9:
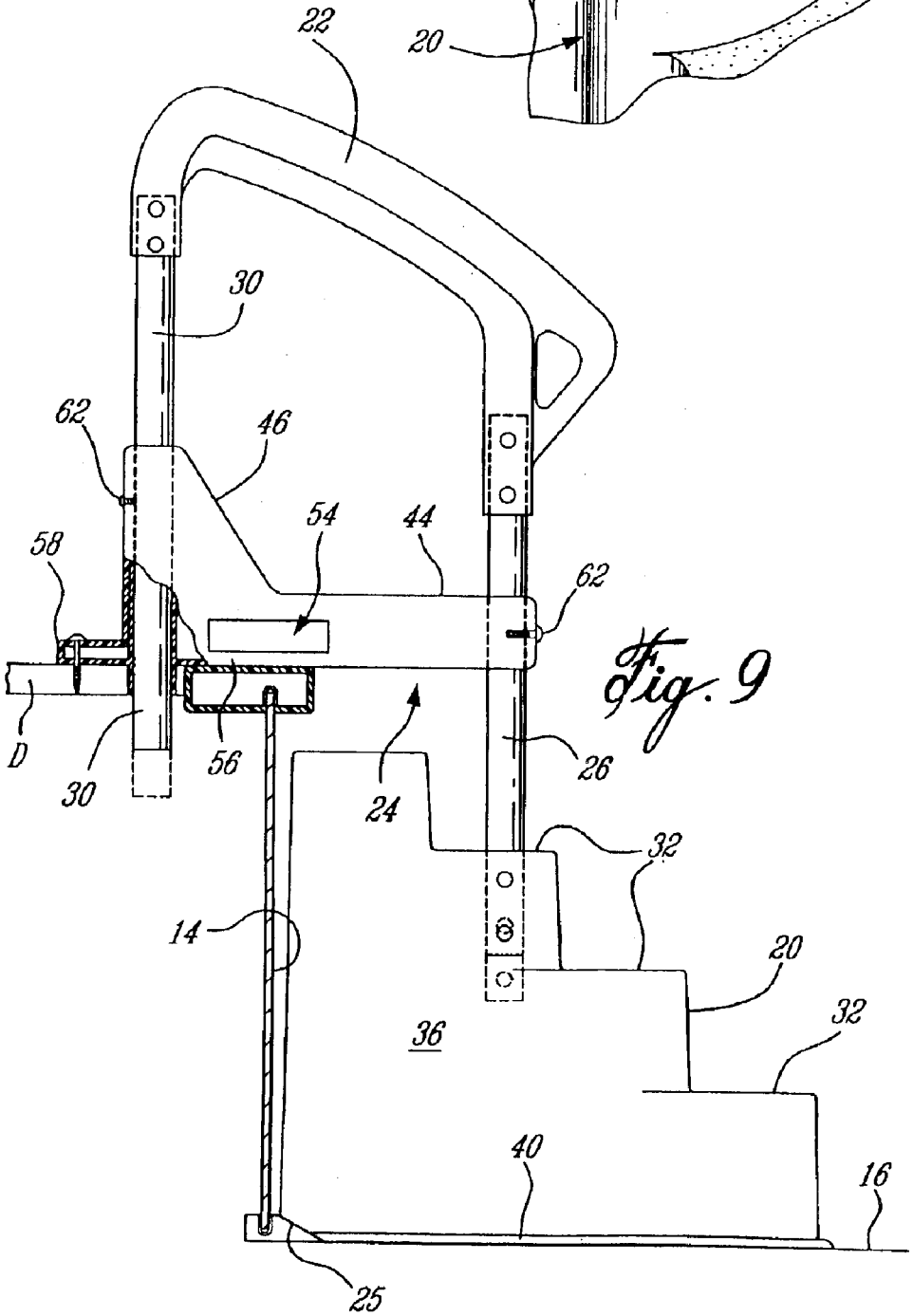
FIG. 9 is a side elevational view of another embodiment of the swimming pool stairs.

The stairs 10 have a stair portion 20, handrails 22 and pool connectors 24, and these are all interconnected by pairs of uprights 26, 28 and 30. More particularly, the uprights 26 connect the stair portion 20 to a bottommost point of the handrails 22. The pool connectors 24 are slidingly engaged on the uprights 26. The uprights 28 connect the pool connectors 24 to the stair portion 20, and the uprights 30 connect the uppermost point of the handrails 22 to the pool connectors 24. The uprights 28 are optional and thus not present on the stairs 10 illustrated in FIGS. 2 and 9.

Figure 2:
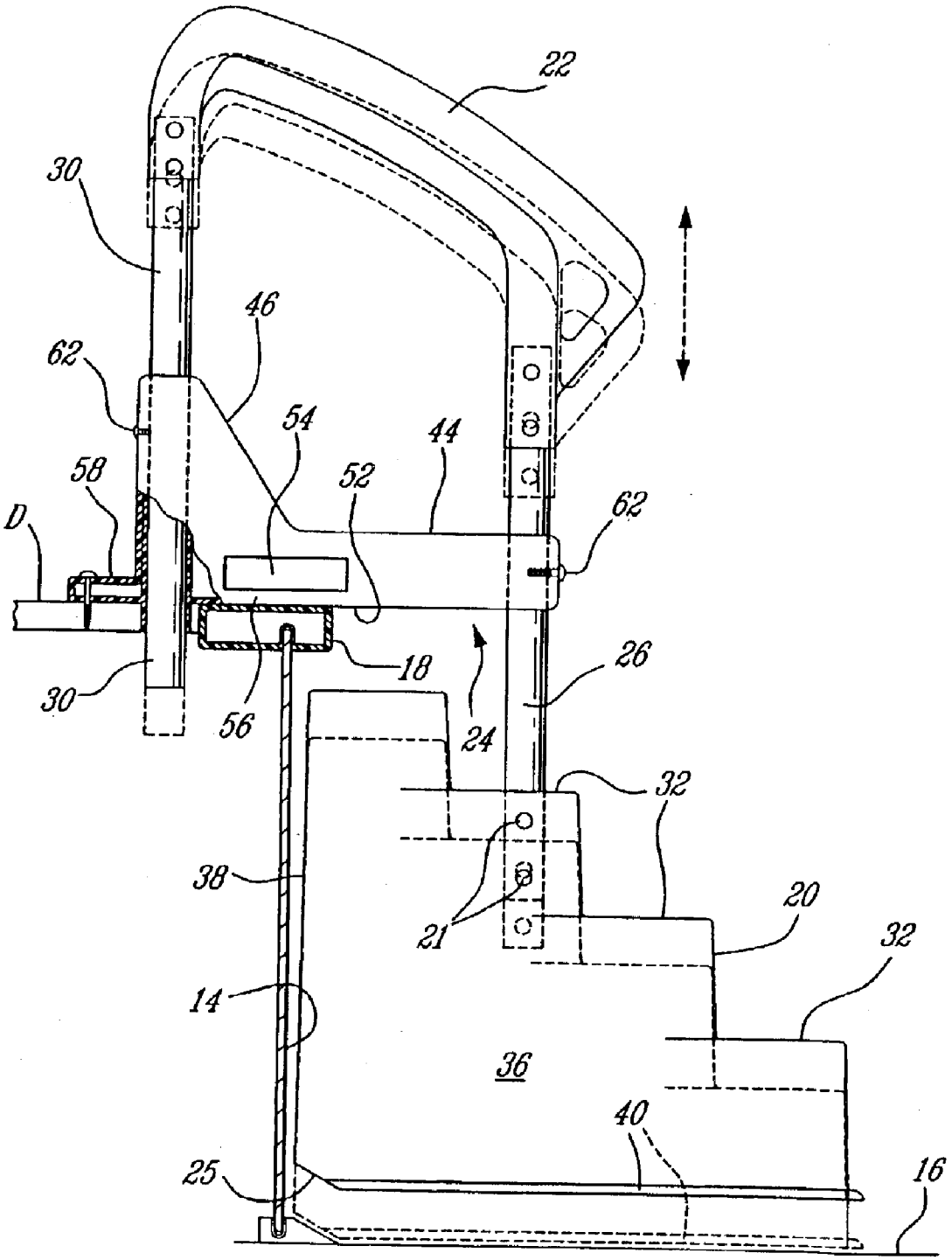
FIG. 2 is a side elevational view of the swimming pool stairs.

Still referring to FIG. 1, the stair portion 20 is shown having four steps 32, which are separated by risers 34. The steps 32 have an anti-skid surface. The anti-skid surface of the steps 32 may consist of small protuberances molded onto the steps 32, or of similar means, for instance, an abrasive such as sand bonded to the anti-skid surface of the steps 32, as depicted in FIG. 1. Lateral walls 36 and rear wall 38 generally complete the shape of the stair portion 20. The stair portion 20 is bottomless, but defines a peripheral lip 40 on a bottom edge thereof. The peripheral lip 40 is provided in order to solidify the stair portion 20. As the stair portion 20 does not have a bottom, the peripheral lip 40 enhances the stiffness of the stair portion 20. Also, the peripheral lip 40 provides a greater surface of contact between the stair portion 20 and the bottom surface 16 of the pool 12. As illustrated in FIG. 2, the bottom rear end of the stair portion may be beveled, as shown by 25, to accommodate an angled edge of the pool 12.

Figure 3:
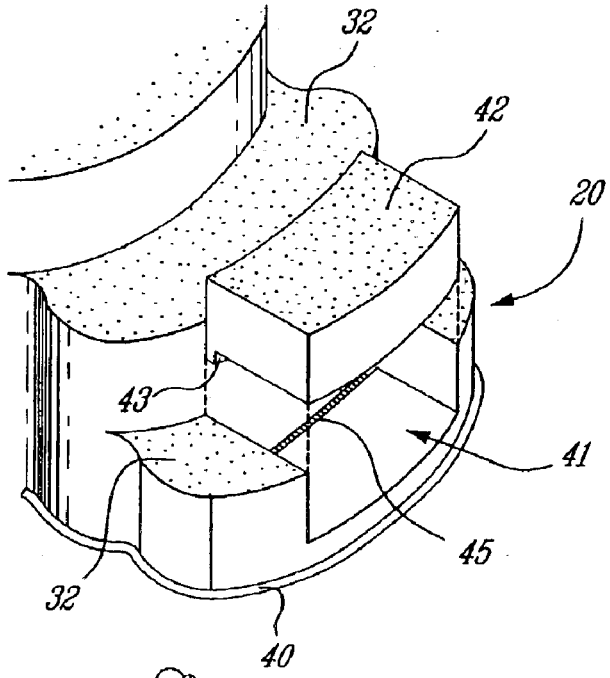
FIG. 3 is an exploded view showing a removable ballast compartment in position for being installed on the swimming pool stairs.
Figure 10:
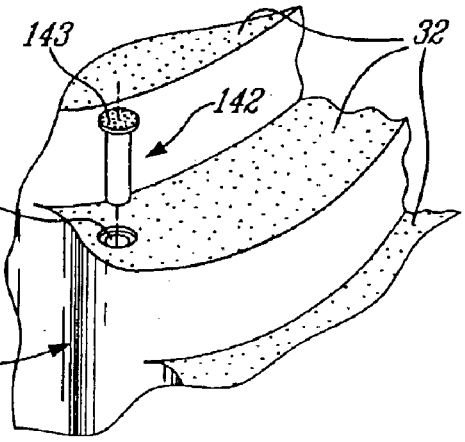
FIG. 10 is an enlarged perspective view of a ballast in accordance with another embodiment of the present invention.

As best seen from FIG. 1, the lateral walls 36 define a sinuous shape. It is pointed out that the sinuous shape is for strengthening the stair portion 20 and for ornamental purposes, and is such that the steps have an arcuate shape. Moreover, the sinuous shape of the lateral walls 36 will facilitate the stackability of the stair portions 20, as will be described hereinafter. However, the lateral walls 36 and the steps 32 could also have straight edges or other ornamental configurations. The stair portion 20 is typically molded and consists of a plastic material, which preferably has a density greater than water so as to avoid floating and thus sinking to the bottom of the pool 12. A removable ballast compartment 42 is connected to and integrated into a bottommost one of the steps 32 and is shaped so as to be snugly received in a corresponding cavity of the bottommost step 32 so as to serve as a step when fitted in the cavity. An example of a possible configuration is illustrated in FIG. 3, wherein the ballast compartment 42 is received in a cavity 41 in the stair portion 20. Other possible embodiments include a ballast in the shape of a cylinder 142, as shown in FIG. 10, received in a corresponding cavity 141. The cylinder 142 has a flanged head 143 so as to be retained in the cavity 141 by gravity.

In the embodiment of FIG. 3, the removable ballast compartment 42 is provided for receiving a ballast that will stabilize the stair portion 20 on the bottom surface of the pool 12. In the prior art, sandbags were used as ballasts as the stair portions usually defined inner cavities with a bottom surface thereof. The ballasts are advantageously positioned in the removable ballast compartment 42, which is easily installed on or removed from the stair portion 20, thereby facilitating the installation and the displacement of the stair portion 20 in the pool 12. In the prior art stairs, the installation of ballasts within inner cavities, on the bottom surface, was hard to achieve. Such inner cavities also required either a substantial amount of time for the removal of water therefrom, or the lifting of heavier weights due to the water remaining in the inner cavities.

The stair portion 20 of the present invention, with its bottomless, will easily be maneuverable in the water, yet be heavy enough to sink to the bottom of the pool 12. As seen in FIG. 3, once the stair portion 20 is positioned in the swimming pool 12, the ballast compartment 42 is positioned in the cavity 41, thereby anchoring the stair portion 20 to a desired position in the pool 12. The same steps of installation apply to the cylinder-shaped ballast 142 of FIG. 10. The ballast in the ballast compartment 42 may be sand, gravel, or any heavy material. The ballast compartment 42 has a lip 43 at the rear of a bottom surface thereof, for engaging into a groove 45 in the cavity 41 of the stair portion 20, whereby horizontal displacement of the ballast compartment 42 is prevented.

Figure 7:
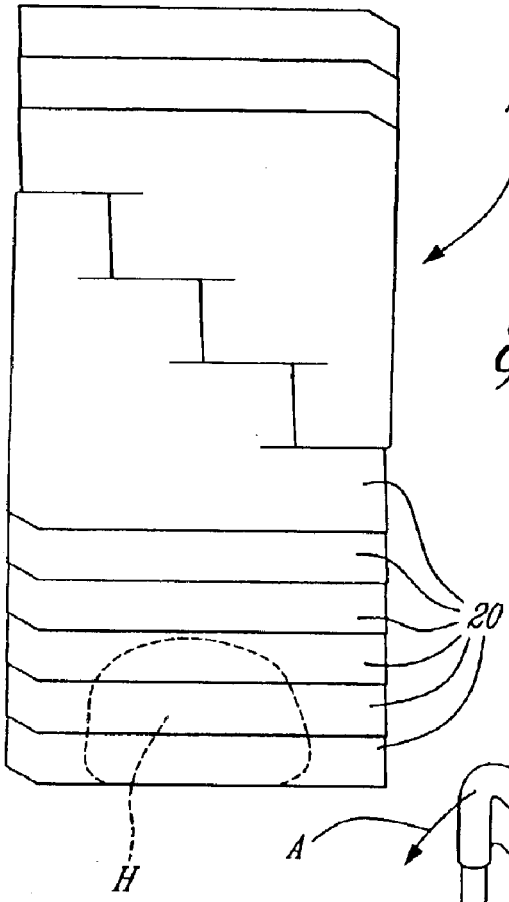
FIG. 7 is a side elevational view of a stacked stair portion of the swimming pool stairs of the present invention.

As best seen in FIG. 7, the transportation and the warehousing space savings aspects are improved by the bottomless configuration of the present invention, as stair portions 20 may be stacked in a nested manner one within the other. Transportation costs are greatly reduced as the result of the nesting, which reduces the volume taken by the stair portions 20. In order for an efficient stacking of the stair portions 20, the latter are shaped in a taper from bottom to top, although not clearly visible in FIG. 1. As mentioned above, the sinuous shape of the lateral walls 36 facilitates the stacking. The strength of the stair portion 20 is enhanced by the sinuous shape, whereby deformation is reduced. Accordingly, when stair portions 20 are nested one onto the other, they will be more readily separated from one another if they do not deform.

Still referring to FIG. 7, packages of hardware are generally shown at H, positioned in the cavity of the bottommost stair portion 20. The packages of hardware H include the handrails 22 and pool connectors 24, the uprights 26, 28 (if applicable) and 30, the necessary fasteners for assembly, and other components if applicable. Accordingly, transportation volume is optimized. Moreover, it is possible to stack other stair portions 20 in a reversed position in top of the first stack of stair portions 20, as shown at 20'. For instance, two stacks of four stair portions 20 on top of each other and positioned on a pallet is an optimal transport configuration.

The top two steps 32 of the stair portion 20 have on opposite sides holes for receiving therein the pairs of uprights 26 and 28. As seen in FIG. 1, the uprights 26 and 28 are secured to the stair portion 20 using typical fasteners such as screws 21. It is also conceivable that, the handrails 22, the pool connectors 24 and the uprights 26, 28 and 30 may be immovably fixed to the deck D and the uprights 26 and 28 simply extend in their respective holes 26' and 28' formed in their respective steps 32, such that the stair portion 20 can slide along the uprights 26 and 28. This would facilitate the installation and the removal of the stairs 10.

Figure 5:
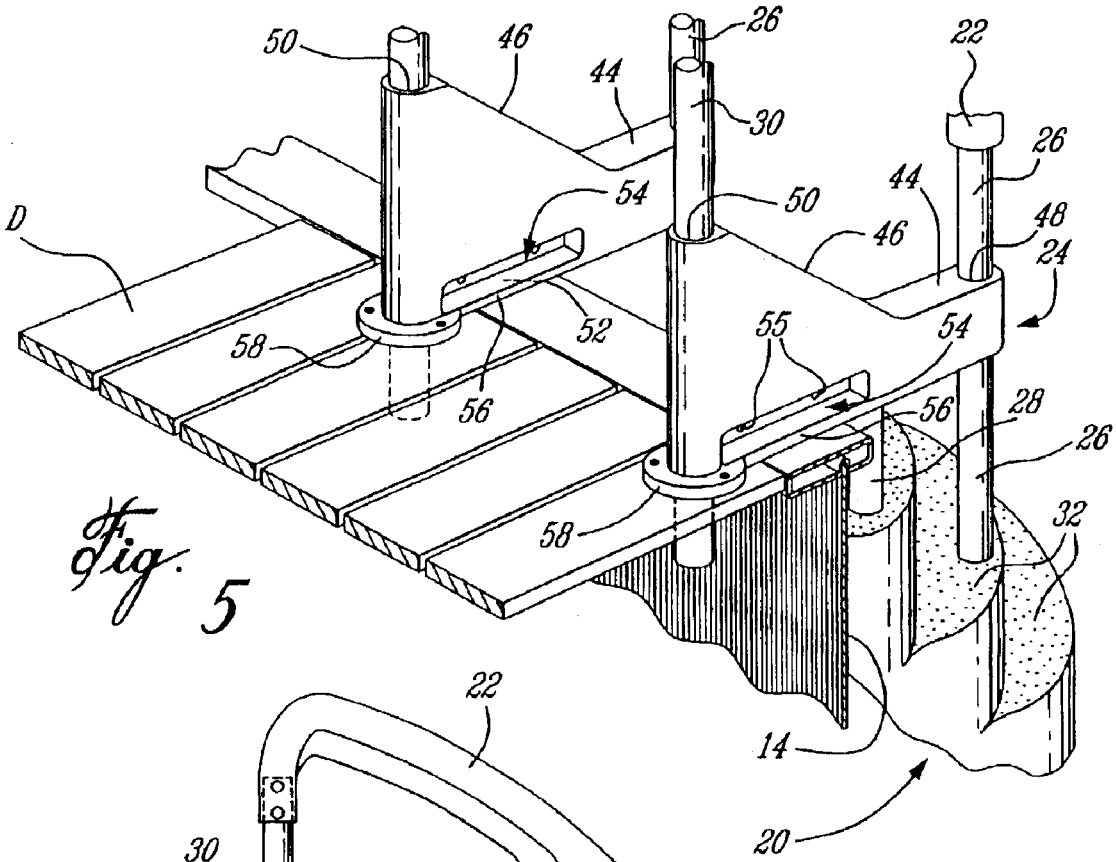
FIG. 5 is an enlarged perspective view of the swimming pool stairs as installed on a deck adjacent to the swimming pool.

As seen in FIGS. 1 and 5, the pool connectors 24 have an elongated body 44 with a triangular support portion 46 rising upwardly away from the pool 12. Opposed ends of the elongated body 44 comprise through bores 48 and 50, respectively adapted to receive the uprights 26 and the uprights 30, whereas a middle portion of the elongated body 44 receives the uprights 28. Due to the triangular support portion 46, the pool connectors 24 have a large contact surface with the uprights 30, thereby increasing the stability in the connection therewith. A bottom edge surface 52 of the elongated body 44 sits on the ledge 18 of the pool 12. Channels 54 are provided just above the bottom edge surface 52, opposite the ledge 18, thereby defining a flange 56 that allows the pool connector 24 to be fixed to the planks of a deck D. More precisely, the flange 56 has a rounded portion 58 that surrounds a rear end of the pool connectors 24. Although the pool connectors 24 are illustrated as being fixed to deck D, they are also adapted for being fastened to concrete, in the case of an in-ground pool. The channels 54 are provided to receive opposed ends of a ladder top 76, that will sit on the seat 18. Holes are provided for securing the ladder top 76 in the channels 54.

Returning to FIG. 1, the handrails 22 are shown both connected to the top ends of uprights 26 and 30. The handrails are obviously provided for helping a person getting into and out of the pool 12. The illustrated handrails 22 have a handle portion 64, and are typically molded with a friction surface so as to enable a solid grasp by a user of the stairs 10. The handrails 22 are fixed to the top ends of the uprights 26 and 30.

In the preferred embodiment of the present invention, the vertical positioning of the stair portion 20 is adjustable with respect to the pool connectors 24 so as to adapt the stairs 10 to various heights of the sidewall 14 in the case of an aboveground pool. The stairs 10, adjustable vertically, do not have the uprights 28. As mentioned previously, the uprights 26 and 30 can slide in the pool connectors 24.

Figure 8:
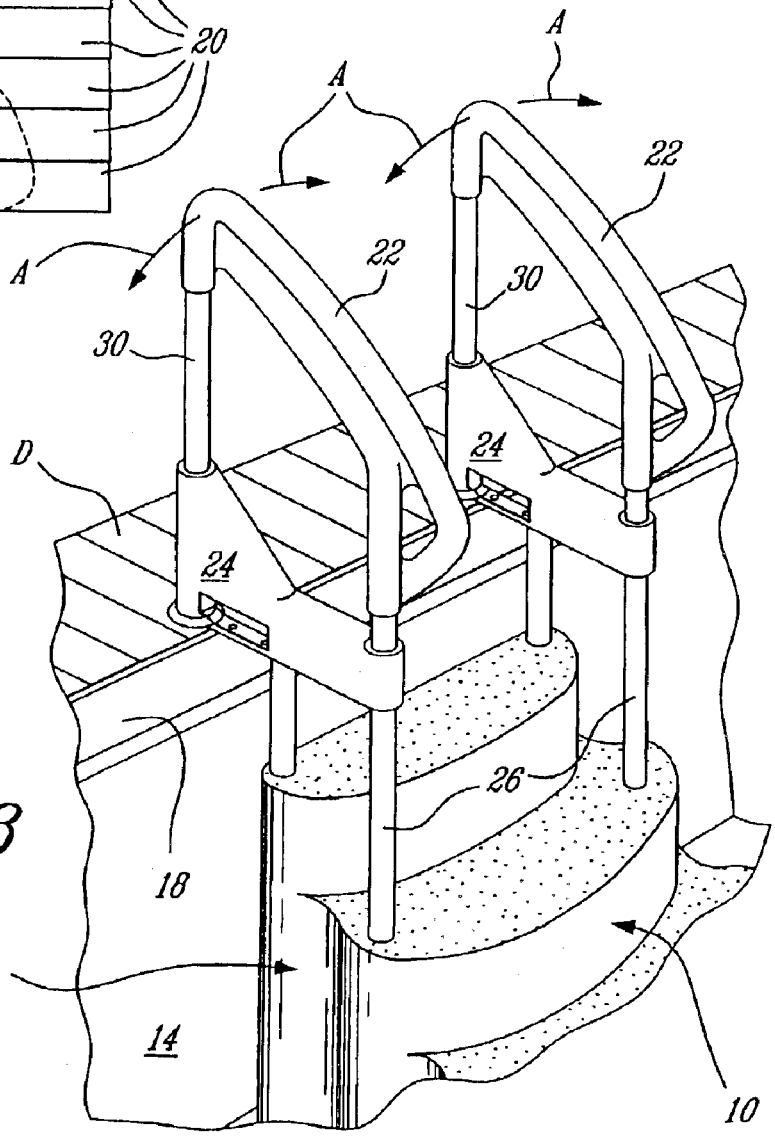
FIG. 8 is a perspective view of a pivoting adjustment of a pool connector portion of the swimming pool stairs.

Once the stair portion 20 has been positioned at a desired position in the pool 12, the assembly of the uprights 26 and 30 with the handrails 22 and the pool connectors 24 is disposed on the seat 18, with the uprights 26 received in the corresponding holes 26' of the stair portion 20. As the pool connector 24 is in translational relation with the uprights 26 and 30, the vertical adjustment is readily performed by sliding the uprights 26 and 30, and thus the handrails, into a desired vertical position. As illustrated in FIG. 8, the stairs 10 without the uprights 28 enable pivoting of the handrails 22/pool connectors 24 about an axis of the uprights 26, as illustrated by arrows A. Thereafter, the pool connectors 24 are fastened to the deck D, as described previously.

Still referring to FIG. 2, the vertical adjustment described above is easily achieved for an aboveground pool having a deck D coplanar with the ledge 18 of the pool. There are various ways to achieve the vertical adjustment in an in-ground pool. For instance, a receiving hole may be drilled in the concrete so as to enable the vertical displacement of the uprights 30. Also, the length of the uprights 30 may be calculated prior to installing the stairs 10 in the pool, whereby the uprights 30 may be cut to an appropriate length so as to be coterminous with the ground level.

Figure 4:
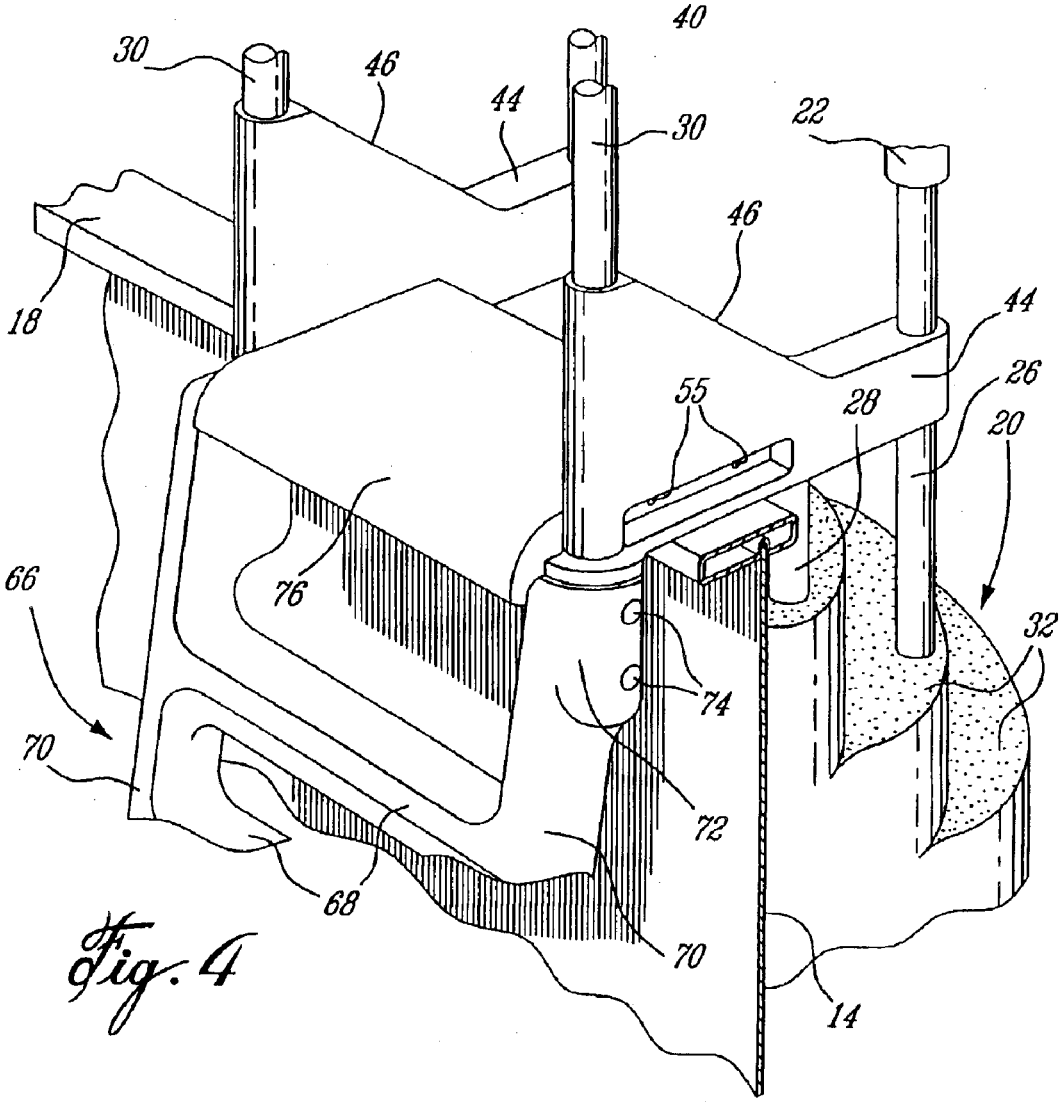
FIG. 4 is an enlarged perspective view of the swimming pool stairs with a ladder, as installed on a swimming pool.
Figure 6:
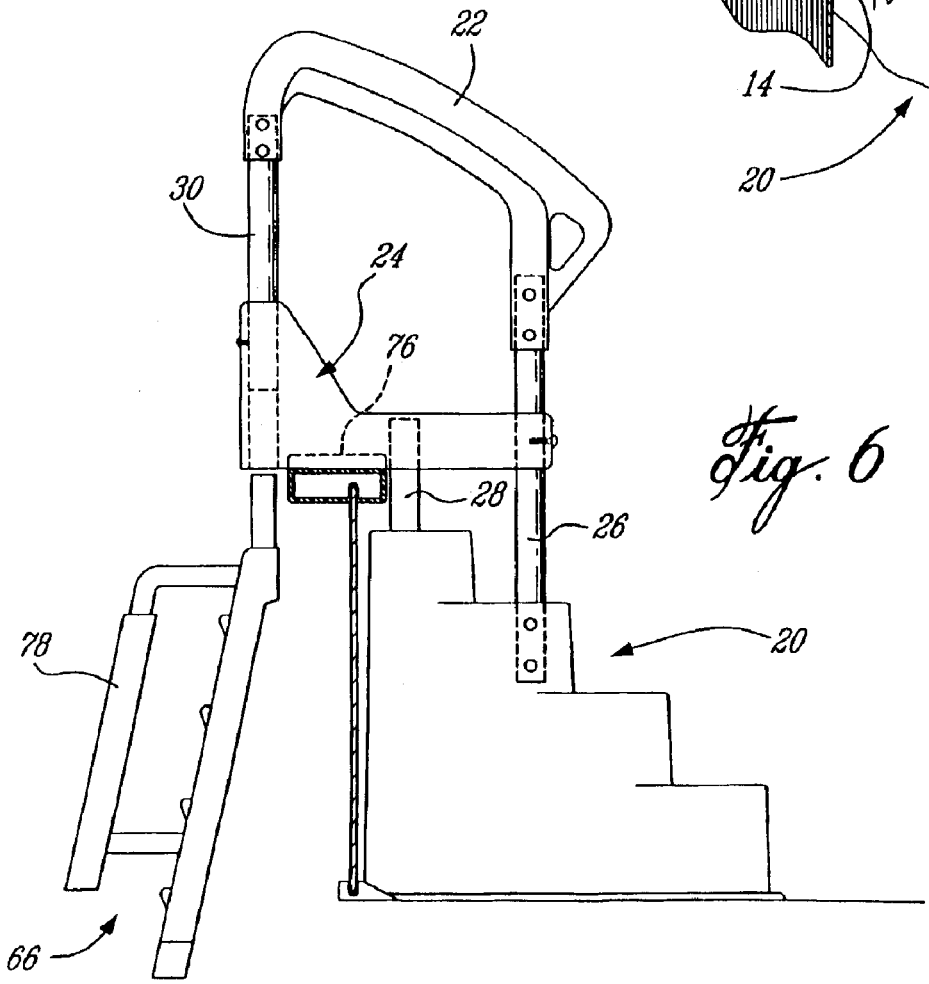
FIG. 6 is an exploded side elevational view of the swimming pool stairs with a ladder.

Referring now to FIGS. 4 and 6, the stairs 10 are shown provided with other accessories, namely a ladder 66 to be used typically with an aboveground pool that does not have a deck D adjacent thereto. The ladder 66 typically has horizontal bars 68 held between a pair of stringers 70. The ladder 66 has housings 72 on top ends of the stringers 70. The housings 72 define cylindrical cavities (not shown) adapted for receiving therein bottom end portions of the uprights 30. Screws 74 allow the ladder 66 to be fastened to bottom end portions of the uprights 30.

Still referring to FIGS. 4 and 6, the stairs 10 are provided with the ladder top 76 and ladder handrails 78. The ladder top 76 ensures a transition between the ladder 66 and the stair portion 20. The ladder top 76 is a generally flat plate having no sharp edges and sitting on the ledge 18 of the aboveground pool 12. As mentioned previously, the ladder top 76 is received in the channels 54, and fasteners 55 are used to fix the ladder top 76 to the pool connectors 24. The ladder top 76 can be strapped to the seat 18 to stabilize the assembly. Obviously, fasteners such as screws could be used to fasten the ladder top 76 to the seat 18.

Although not illustrated herein, it is pointed out that the stairs 10 may be adjustable vertically even if they are provided with the ladder 66. In such a case, the bottom 16 will most frequently be coplanar with the ground level at which the ladder 66 will be resting. Accordingly, both the stair portion 20 and the ladder 66 are vertically adjusted by the sliding relation between the pool connector 24 and the uprights 26 and 30, and using the fastener screws 62. The fastener screws 62 secure the pool connectors 44 in position to the uprights 26 and 30.

It is within the ambit of the present invention to cover any obvious modifications of the preferred embodiment described herein, provided such modifications fall within the scope of the appended claims.

What is claimed is:

1. A stair portion for a stair assembly for a swimming pool, comprising a bottomless hollow body having lateral surfaces and a top surface defining steps, the bottomless hollow body adapted to be received in a pool with at least one bottom edge of the lateral surface lying against a bottom of the pool such that a user person can move in or out of the pool using the steps, the bottomless hollow body adapted to be connected to a pool connector portion for being secured adjacent to a sidewall of the pool, the bottomless hollow body having a ballast receiving portion for receiving a ballast to stabilize the stair portion once installed in the pool, the bottomless hollow body tapering from bottom to top such that the bottomless hollow body is capable to matingly receive another one of the bottomless hollow body for forming a stack of bottomless hollow bodies, so as to facilitate at least one of transportation, warehouse storage, manoeuvrability and installation in a body of water.

2. The stair portion according to claim 1, wherein said at least one bottom edge has a lip to increase a contact area between the bottomless hollow body and a bottom of the pool.

3. The stair portion according to claim 1, wherein the lateral surfaces define a sinuous pattern in a transverse horizontal cross-section to strengthen the bottomless hollow body.

4. The stair portion according to claim 1, wherein one of the steps is recessed for receiving the ballast therein.

5. The stair portion according to claim 4, wherein the ballast is matingly received in the recess such that the ballast serves as at least a portion of said one of the steps.

6. The stair portion according to claim 5, wherein the ballast and the recess are cylindrically shaped.

7. The stair portion according to claim 5, wherein the recess is a compartment defined in said one of the steps.

8. The stair portion according to claim 7, wherein the compartment and the ballast are secured to one another by mating engagement therebetween.

9. The stair portion according to claim 8, wherein the mating engagement is achieved by a lip of the ballast shaped for retention fit in a lip retention groove of the compartment.

10. The stair portion according to claim 1, wherein the tapering of said bottomless hollow body from bottom to top determines a nesting depth between nested ones of the bottomless hollow body.

11. The stair portion according to claim 1, wherein the pool connector portion is adapted to be secured to a ledge of the pool and has a translationary coupling with said bottomless hollow body for vertical adjustment therebetween as a function of one of a height of a sidewall and a depth of the pool.

12. The stair portion according to claim 11, wherein the pool connector portion has at least one connector adapted to be secured to the ledge of the pool, and at least one upright secured to the bottomless hollow body and in sliding engagement with the at least one connector to enable said translationary coupling between said pool connector portion and said bottomless hollow body.

13. The stair portion according to claim 12, wherein the pool connector portion further comprises at least one handle portion connected to the at least one upright so as to be displaced with the bottomless hollow body, the at least one handle being provided to facilitate access to the pool by a user person.

14. The stair portion according to claim 13, wherein the at least one handle portion and the at least one pool connector portion are pivotable with respect to a longitudinal axis of the at least one upright for a horizontal positioning of the pool connector portion with respect to the pool.

15. The stair portion according to claim 11, wherein the pool connector portion has a ladder mounted thereto so as to be displaceable in a vertical translation with respect to the pool connector portion, to provide for vertical adjustment of the ladder as a function of a height of the ledge of the pool.

16. The stair portion according to claim 15, wherein the pool connector portion has at least one upright secured to the ladder portion and in sliding engagement with the pool connector portion to enable said vertical adjustment.

17. A stair assembly for a swimming pool comprising:

a stair portion defining steps and adapted for being received in a pool, said stair portion having a ballast; and pool connector portion connected to said stair portion for securing said stair portion adjacent to a sidewall of the pool, said pool connector portion having at least one connector adapted to be secured to a ledge of the pool, and at least one upright secured to said stair portion and in sliding engagement with the at least one connector to enable a translationary coupling between said pool connector portion and said stair portion for vertical adjustment therebetween as a function of one of a height of a sidewall and a depth of the pool;

wherein the pool connector portion further comprises at least one handle portion connected to the at least one upright so as to be displaced with the bottomless hollow body, the at least one handle being provided to facilitate access to the pool by a user person.

18. The stair assembly according to claim 17, wherein the at least one handle portion and the at least one pool connector portion are pivotable with respect to a longitudinal axis of the at least one upright for a horizontal positioning of the pool connector portion with respect to the pool.

19. A stair assembly for a swimming pool comprising:

a stair portion defining steps and adapted for being received in a pool, said stair portion having a ballast; and a pool connector portion connected to said stair portion for securing said stair portion adjacent to a sidewall of the pool, said pool connector portion having at least one connector adapted to be secured to a ledge of the pool, and at least one upright secured to said stair portion and in sliding engagement with the at least one connector to enable a translationary coupling between said pool connector portion and said stair portion for vertical adjustment therebetween as a function of one of a height of a sidewall and a depth of the pool;

wherein the pool connector portion has a ladder mounted thereto so as to be displaceable in a vertical translation with respect to the pool connector portion, to provide for vertical adjustment of the ladder as a function of a height of the ledge of the pool.

20. The stair assembly according to claim 19, wherein the pool connector portion has at least one upright secured to the ladder portion and in sliding engagement with the pool connector portion to enable said vertical adjustment.

21. A stair portion for a stair assembly for a swimming pool, comprising:

a hollow body having lateral surfaces and a top surface defining steps, one of said steps having a ballast receiving portion, the hollow body adapted to be received against a bottom of a pool such that person can move in or out of the pool using the steps, the hollow body adapted to be connected to a pool connector portion for being secured adjacent to a sidewall of pool; and a ballast adapted to be received in the ballast receiving portion such that said ballast serves as at least a portion of said one of said steps;

wherein the ballast receiving portion is a compartment defined in one of the steps, and the ballast is matingly received in the ballast receiving portion to form a portion of said one of the steps.

22. The stair portion according to claim 21, wherein the compartment and the ballast are secured to one another by mating engagement therebetween.

23. The stair portion according to claim 22, wherein the mating engagement is achieved by a lip of said ballast shaped for retention fit in a lip retention groove of said compartment.

24. A stair portion for a stair assembly for a swimming pool, comprising:

a hollow body having lateral surfaces and a top surface defining steps, one of said steps having a ballast receiving portion, the hollow body adapted to be received against a bottom of a pool such that a person can move in or out of the pool using the steps, the hollow body adapted to be connected to a pool connector portion for being secured adjacent to a sidewall of the pool; and a ballast adapted to be received in the ballast receiving portion such that said ballast serves as at least a portion of said one of said steps;

wherein the ballast and ballast receiving portion are cylindrically shaped.

25. A method of handling swimming pool stair portions for facilitating one of transportation, warehouse storage and manoeuvrability, said method comprising:

providing first and second swimming pool stair portion, each of said first and second swimming pool stair portions having a bottomless hollow body defining steps, the bottomless hollow body tapering from bottom to top;

nesting either one of said first and second swimming pool stair portions within the other of said first and second swimming pool stair portions to form a stack; and storing articles within the hollow body of the bottom-most swimming pool stair portion of said stack.

* * * * *